US006158087A

United States Patent [19]

Cheung

[11] Patent Number: 6,158,087

[45] Date of Patent: Dec. 12, 2000

[54] QUICK RELEASE HINGE SYSTEM

[76] Inventor: Maxwell C. Cheung, 8 Sycamore Creek, Irvine, Calif. 92612

[21] Appl. No.: 09/285,361

[22] Filed: Apr. 2, 1999

[51] Int. Cl.[7] ..... E05D 7/10

[52] U.S. Cl. ..... 16/262; 16/374; 16/386; 16/387

[58] Field of Search ..... 16/262, 260, 261, 16/257, 258, 259, 263, 266, 268, 271, 273, 374, 386, 387, 375

[56] References Cited

U.S. PATENT DOCUMENTS

| | | | |
|---|---|---|---|
| 3,188,686 | 6/1965 | Orcutt | 16/262 |
| 3,256,552 | 6/1966 | Sterner | 16/374 |
| 3,826,565 | 7/1974 | Wenzel | 16/228 |
| 4,790,047 | 12/1988 | Myslicki | 16/386 |
| 5,577,295 | 11/1996 | Papke et al. | 16/254 |
| 5,709,500 | 1/1998 | Mizelle et al. | 16/386 |
| 5,739,425 | 4/1998 | Binnig et al. | 73/105 |

*Primary Examiner*—Chuck Y. Mah
*Attorney, Agent, or Firm*—Raymond Sun

[57] ABSTRACT

A hinge system is provided to connect a first structure and a second structure. The first structure has a first pad eye extending from a connecting wall, with a tapered hole extending through the first pad eye. The second structure has a second pad eye extending from a connecting wall of the second structure, with a hole extending through the second pad eye. The hinge system further includes a pin having a first end and a second end, with the diameter of the first end smaller than the diameter of the second end. The first and second pad eyes are positioned such that the holes in the first and second pad eyes are aligned with each other, and the pin is inserted into the holes in the first and second pad eyes.

14 Claims, 5 Drawing Sheets

QUICK RELEASE HINGE SYSTEM

BACKGROUND OF THE INVENTION

1. Field of the Invention

The present invention relates to hinge systems, and in particular, to a quick release hinge system that exerts minimal friction force during the insertion and removal of the pin.

2. Description of the Prior Art

Traditional hinge systems consist of a series of pad eyes that are alternately attached to two separate structures that are intended to be hingedly connected. Each of these pad eyes has a hole having the same diameter, with the centers of the holes aligned in a straight line. A cylindrical pin is then inserted into the aligned holes to join the two structures together. These two structures can then be pivoted about an axis defined by the pin. A very simple example of such a hinge system can be found in doors.

Floating structures can also be connected using the conventional hinge system described above. When two floating structures are being connected in a controlled environment, the state of the sea is generally calmer so that the centers of the holes in the pad eyes can be visibly aligned to receive the pin. Therefore, the connection operation is easy and safe to perform.

However, after the structures have been connected for a period of time, the weight or flotation distributions of both structures could be altered due to other operational requirements. In effect, the extra weight from one end of one structure may be supported by the flotation of the other structure. As a result, large amounts of shear force can be accumulated in the pin. The shear force creates friction force between the pin and the pad eyes, which makes it difficult to pull out the pin when the two structures need to be separated. Without monitoring the magnitude of the shear force, the operator will have difficulty estimating the equipment needed to pull out the pin if the two structures are to be separated. If the shear force is high, the two structures will move rapidly opposite to each other once the pin exits the last pad eye because there is no shear force to hold the two structures together. In general, the harder the pull, the higher the shear force exists, and the faster the resulting relative motions of the two structures. If the sea environment happens to be rough at the time of the separation operation, this operation will be much more dangerous and difficult when compared to the initial connection operation, thereby increasing the possibility of structural damage to the structures, and human injury.

SUMMARY OF THE DISCLOSURE

In light of the above, it is an objective of the present invention to provide a hinge system that is easy to connect and to disconnect.

It is another objective of the present invention to provide a hinge system that provides quick release during the separation of two connected structures.

It is a further objective of the present invention to provide a hinge system that exerts minimal friction force during the insertion and removal of the pin.

It is yet another objective of the present invention to provide a hinge system that provides a better distribution of the shear forces at the connection.

In order to accomplish the objects of the present invention, there is provided a hinge system that is used to connect a first structure and a second structure. The first structure has a first pad eye extending from a connecting wall, with a tapered hole extending through the first pad eye. The second structure has a second pad eye extending from a connecting wall of the second structure, with a hole extending through the second pad eye. The hinge system further includes a pin having a first end and a second end, with the diameter of the first end smaller than the diameter of the second end. The first and second pad eyes are positioned such that the holes in the first and second pad eyes are aligned with each other, and the pin is inserted into the holes in the first and second pad eyes.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

Figure 1B:
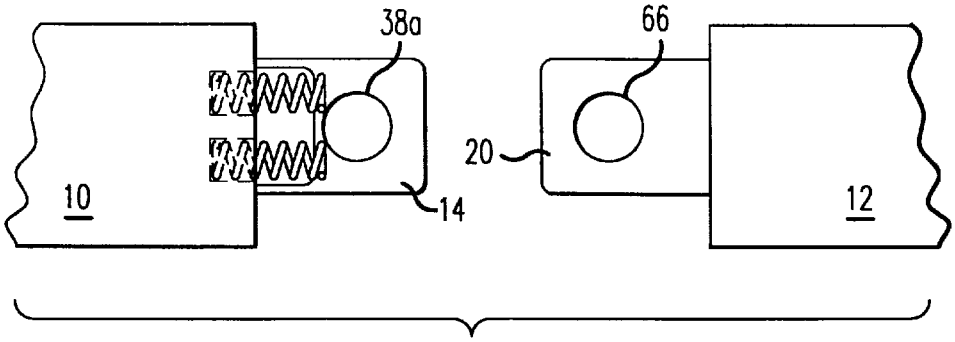
FIG. 1B is an exploded side view of the hinge system of FIG. 1A taken along center axis CA.
Figure 1A:
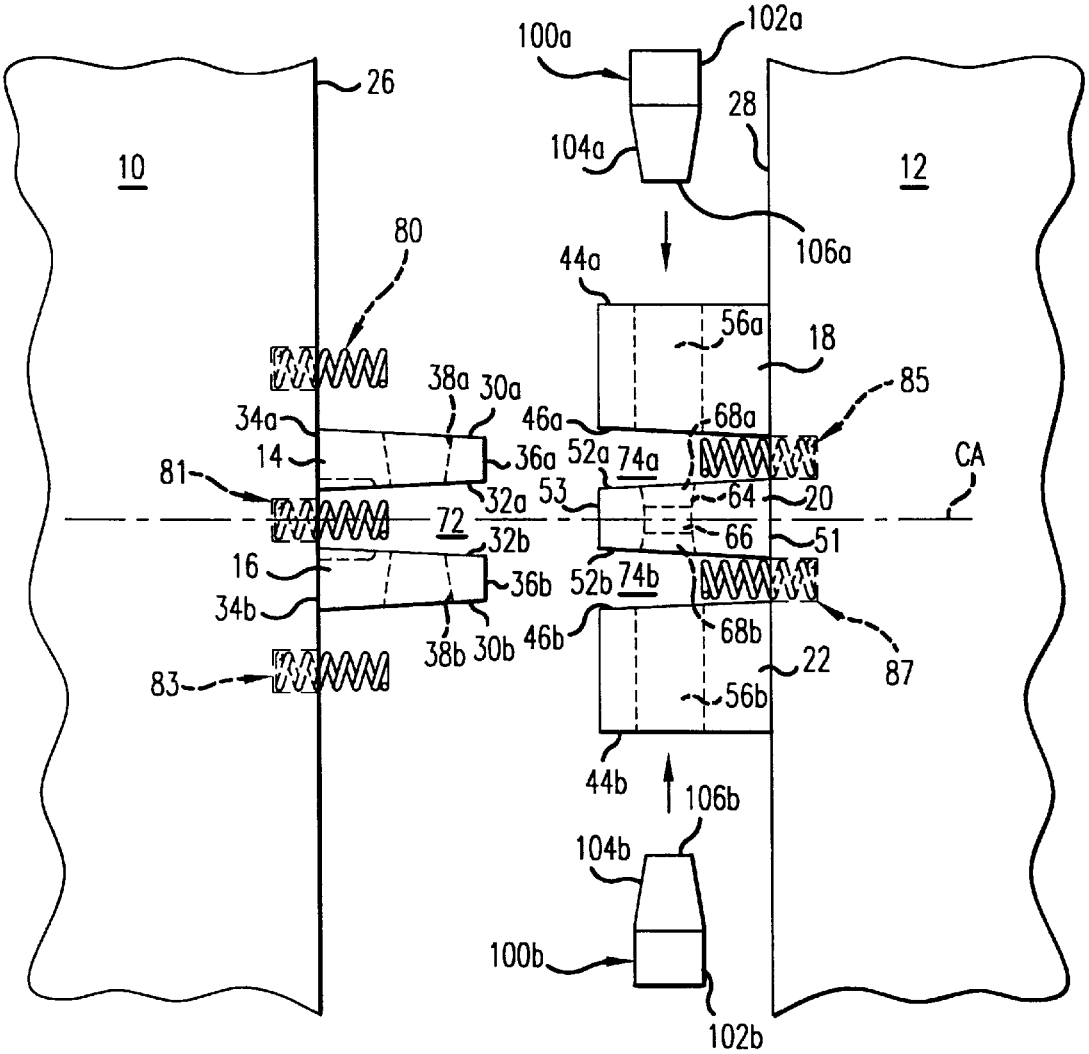
FIG. 1A is an exploded top plan view of a hinge system according to the present invention.

FIGS. 1A and 1B illustrate two separate structures 10 and 12 and the hinge system according to one embodiment of the present invention. The structures 10 and 12 can be two separate floating structures, although the principles of the present invention are equally applicable for use with other structures. The hinge system according to the present invention includes, for example, five opposing pad eyes 14, 16, 18, 20, 22, and, for example, one or two generally conical or tapered pins 100, depending on the number of pad eyes actually provided in the hinge system. This will be explained in greater detail below. In particular, structure 10 can be provided with two identical pad eyes 14 and 16 that are spaced apart along a connecting wall 26. Structure 12 can be provided with a center pad eye 20, and a first pad eye 18 and a second pad eye 22 that are symmetrical to each other about the center pad eye 20, with the pad eyes 18, 20, 22 spaced apart along a connecting wall 28.

The pad eye 14 can be provided with a first surface 30*a* and a second surface 32*a*, both of which angle or slope away from the connecting wall 26 towards each other, so that the first and second surfaces 30*a*, 32*a* effectively taper from a wider first end 34*a* that is connected to the structure 10, to a narrow opposite second end 36*a*. Similarly, pad eye 16 can be provided with a first surface 30*b* and a second surface 32*b*, both of which angle or slope away from the connecting wall 26 towards each other, so that the first and second surfaces 30*b*, 32*b* effectively taper from a wider first end 34*b* that is connected to the structure 10, to a narrow opposite second end 36*b*. A tapered hole 38*a* and 38*b* is provided in each pad eye 14 and 16, respectively. Each hole 38*a* and 38*b* is tapered so that it has a greater diameter at a location furthest away from a center axis CA that is disposed between the pad eyes 14, 16. Specifically, the hole 38*a* has a diameter that decreases linearly from the first surface 30*a* of pad eye 14 to the second surface 32*a*, and the hole 38*b* has a diameter that decreases linearly from the first surface 30*b* of pad eye 16 to the second surface 32*b*. Thus, it can be seen that pad eyes 14 and 16 are symmetrical to each other about a center axis CA.

The pad eye 18 can be provided with a generally straight first surface 44*a* that is generally perpendicular to the connecting wall 28, and a second surface 46*a* which angles or slopes away from the connecting wall 28 towards the first surface 44*a*. Similarly, the pad eye 22 can be provided with a generally straight first surface 44*b* that is generally perpendicular to the connecting wall 28, and a second surface 46*b* which angles or slopes away from the connecting wall 28 towards the first surface 44*b*. The center pad eye 20 is positioned between the pad eyes 18 and 22, and has a first surface 52*a* and a second surface 52*b* that angle or slope away from the connecting wall 28 towards each other and are symmetrical to each other about center axis CA, so that the first and second surfaces 52*a*, 52*b* effectively taper from a wider first end 51 that is connected to the structure 12 to a narrow opposite second end 53. Each pad eye 18 and 22 has a generally cylindrical hole 56*a* and 56*b*, respectively. The center pad eye 20 has a hole 64 that has a narrowed center portion 66, and symmetrical first and second portions 68*a* and 68*b*, respectively, that increase in diameter from the center portion 66 to the first surface 52*a* and second surface 52*b*, respectively. The center axis CA runs through the center of the center portion 66.

Thus, the pad eyes 14 and 16 on structure 10 define a space 72 therebetween that increases from the connecting wall 26 outwardly to the ends 36*a*, 36*b* of the pad eyes 14, 16. This space 72 should resemble the configuration of the opposing center pad eye 20, so that the center pad eye 20 can be fitted inside this space 72 in a manner where the holes 38*a* and 38*b* in pad eyes 14, 16 can be aligned with the hole 64 of center pad eye 20. Similarly, the pad eyes 18 and 20 on structure 12 define a space 74*a* therebetween that increases from the connecting wall 28 outwardly to the end 53 of the center pad eye 20. This space 74*a* should resemble the configuration of the opposing pad eye 14, so that this pad eye 14 can be fitted inside this space 74*a* in a manner where the holes 56*a* and 64 in pad eyes 18, 20 can be aligned with the hole 38*a* of pad eye 14. In the same manner, the pad eyes 20 and 22 on structure 12 define a space 74*b* therebetween that increases from the connecting wall 28 outwardly to the end 53 of the center pad eye 20. This space 76*b* should resemble the configuration of the opposing pad eye 16, so that this pad eye 16 can be fitted inside this space 76*b* in a manner where the holes 64 and 56*b* in pad eyes 20, 22 can be aligned with the hole 38*b* of pad eye 16.

It should noted that the hinge system illustrated in FIG. 1A is symmetrical about the center axis CA, in that the pad eyes 14, 18 and 20 and the space 74*a* is symmetrical to the pad eyes 16, 22 and 20 and the space 74*b*. Thus, the hinge system shown in FIG. 1A can be implemented merely using the pad eyes 14, 18 and 20 and the space 7*a*, without providing the other pad eyes 16 and 22, and spaces 72 and 74*b*, or by merely using the pad eyes 16, 22 and 20 and the space 74*b*, without providing the other pad eyes 14 and 18, and spaces 72 and 74*a*. For this reason, the same numerals are used in FIG. 1A to designate symmetrical elements, except that an "a" or a "b" has been appended to the numeral designations to represent the respective symmetrical elements.

A plurality of bumper systems 80 can be provided in the connecting walls 26 and 28 at locations opposite to the ends of opposing pad eyes. For example, bumper systems 80, 81 and 83 can be provided on connecting wall 26, with bumper system 81 provided inside the space 72 to cushion center pad eye 20, bumper system 80 provided adjacent the side 30*a* of pad eye 14 to cushion pad eye 18, and bumper system 83 provided adjacent the other side 30*b* of pad eye 16 to cushion pad eye 22. Similarly, bumper systems 85 and 87 can be provided on connecting wall 28, with bumper system 85 provided inside the space 74*a* to cushion pad eye 14, and bumper system 87 provided inside the space 74*b* to cushion pad eye 16.

Figure 4:
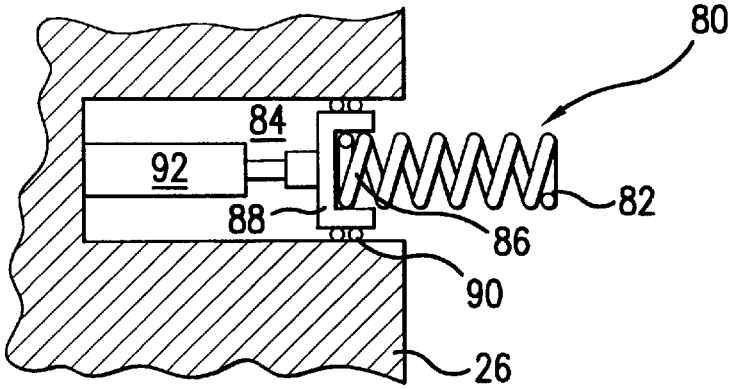
FIG. 4 illustrates the bumper system of FIG. 1A.

Each bumper system 80, 81, 83, 85 and 87 can be identical. Referring now to FIGS. 1A and 4, bumper system 80 is illustrated and can have a retractable coiled spring 82 that is retractable inside a channel 84 provided in the connecting wall 26. The spring 82 can have an inner end 86 that is coupled to a base 88. The base 88 can be supported for reciprocation inside the channel 84 by rollers or bearings 90. A hydraulic piston 92 can be provided for reciprocating the base 88, and the spring 82. Although FIG. 4 illustrates in a very simplified manner one non-limiting example of how the bumper systems can be embodied, it will be appreciated by those skilled in the art that the bumper systems can be embodied in many different ways; as a non-limiting example, using any elastomeric bumper or the like.

The hinge system of the present invention further includes two generally conical or tapered pins 100*a* and 100*b*, both shown in FIG. 1A. Pin 100*a* has a cylindrical section 102*a* that is adapted to fit inside, and slide smoothly within, the hole 56*a*. Pin 100*a* also has a tapered section 104*a*, extending from the cylindrical section 102*a*, which is adapted to fit inside tapered hole 38*a* of pad eye 14. The pin 100*a* has a tapered end 106*a* that can be fitted in the first portion 68*a* of the hole 64. For manufacturing tolerances, the tapered end 106*a* may even extend into the center portion 66 of hole 64. Pin 100*b* can be identical to pin 100*a*, and is adapted to be fitted inside hole 56*b* of pad eye 22, tapered hole 38*b* of pad eye 16, and the second portion 68*b* of hole 64.

FIGS. 2A, 2B, 3A and 3B illustrate how the hinge system of the present invention is connected. From FIGS. 1A and 1B, the two structures 10, 12 are moved towards each other such that the pad eyes 14, 16 and 20 are aligned to fit inside spaces 7*a*, 74*b* and 72, respectively. The tapered surfaces 30*a*, 32*a*, 30*b*, 32*b*, 46*a*, 46*b*, 52*a* and 52*b* of the pad eyes 14, 16, 18, 22, 20 make it easier to insert each pad eye into each corresponding space. Using pad eye 14 as an example, the narrowed end 36*a* has a smaller dimension (i.e., width)

than the opening in space 74*a* due to the widened opening defined by the tapered surfaces 46*a* and 52*a*, so that it is easier to fit the narrowed end 36*a* through the wider opening in space 74*a*. Once the narrowed end 36*a* has found its way into the space 74*a* between pad eyes 18 and 20, it is much easier to cause the pad eye 14 to approach the connecting wall 28 on the other structure 12, since the space 74*a* provides a path of advancement for the pad eye 14. In other words, there will always be a small gap between each set of interfacing tapered surfaces (e.g., between 30*a* and 46*a*, and between 32*a*, and 52*a*) to allow some degree of relative motion between the pad eyes and structures 10, 12 without making hard contact. The insertion of pad eye 16 into space 74*b*, and pad eye 20 into space 72, operate under the same principles.

Figure 2B:
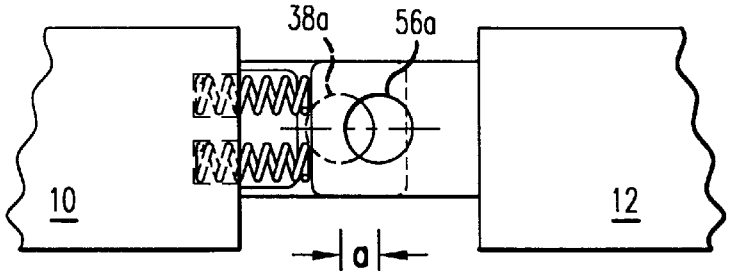
FIG. 2B is an exploded side view of the hinge system of FIG. 2A taken along center axis CA.
Figure 2A:
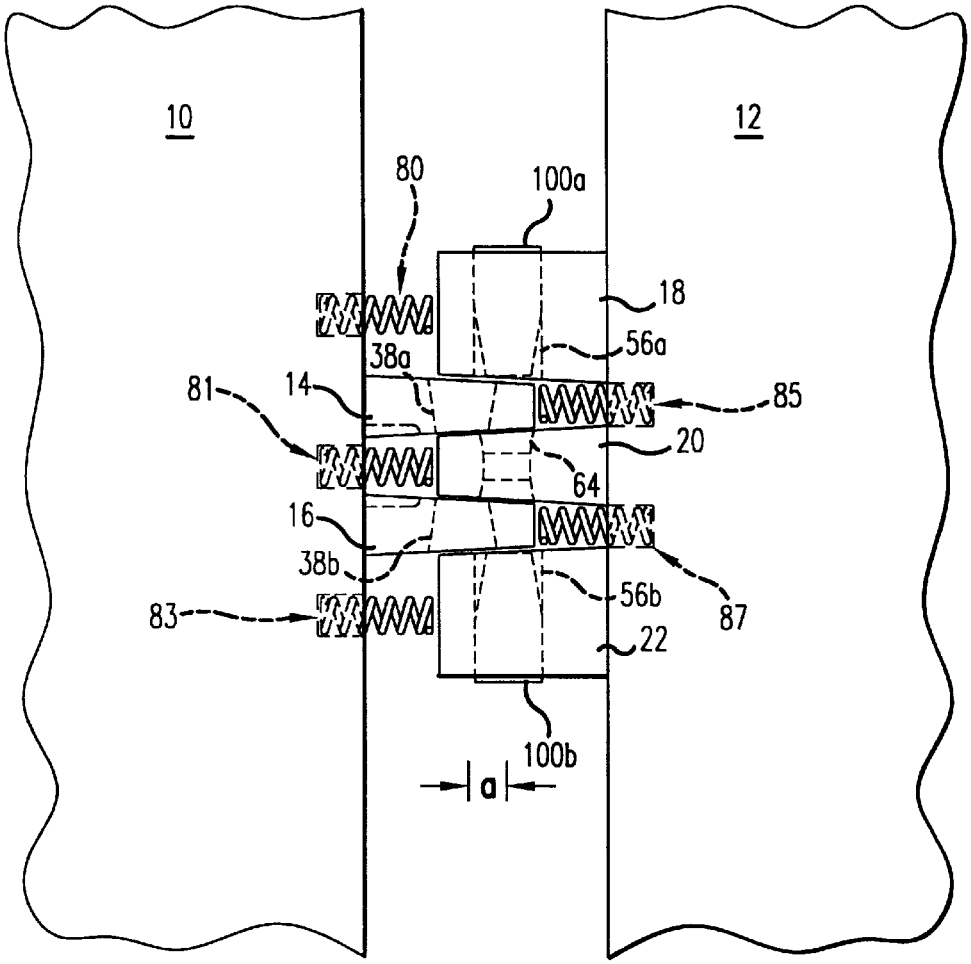
FIG. 2A is an exploded top plan view of the hinge system of FIG. 1 shown as the opposing structures are moved towards each other.

FIGS. 2A and 2B show the pad eyes 14, 16 and 20 fitted inside spaces 74*a*, 74*b* and 72, respectively, to a point where the pad eyes 18, 20, 22, 14 and 16 contact the spring 82 of the bumper systems 80, 81, 83, 85 and 87, respectively. As can be seen in FIGS. 2A and 2B, the holes 38*a* and 38*b* in pad eyes 14 and 16, respectively, of structure 10 are not aligned with the holes 56*a*, 64 and 56*b* in pad eyes 18, 20 and 22, respectively, in structure 12, with the centers of these holes separated by a distance "a" (see FIG. 2B). In addition, FIG. 2A shows pins 100*a* and 100*b* in phantom, occupying the cylindrical holes 56*a* and 56*b*, respectively, and not being able to enter holes 38*a* and 38*b* because of the non-alignment of all the holes. In this position, the springs 82 provide a cushioning effect in the event that an unexpected force causes the structures 10, 12 to be advanced towards each other faster and/or with a greater force than that which was expected. This will help to minimize danger to the operator, and to minimize damage to the structures 10, 12.

Figure 3B:
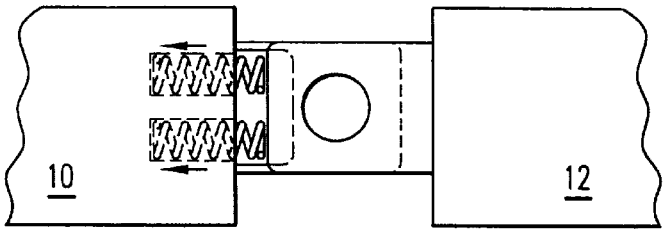
FIG. 3B is an exploded side view of the hinge system of FIG. 3A taken along center axis CA.
Figure 3A:
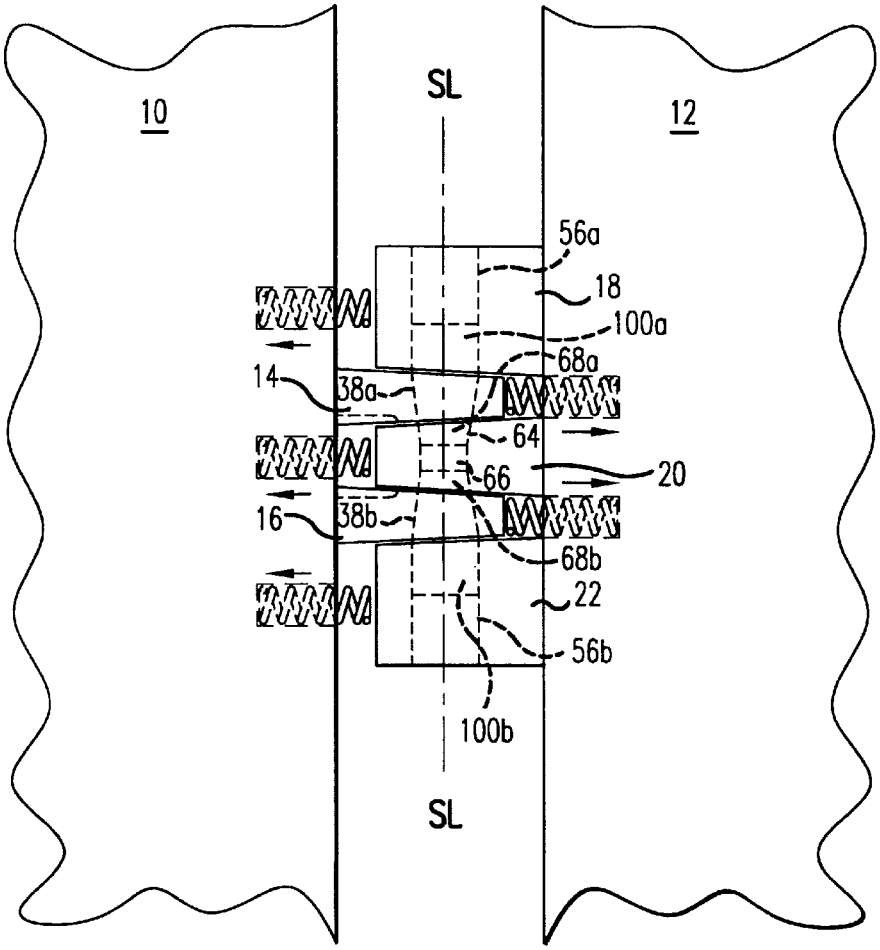
FIG. 3A is an exploded top plan view of the hinge system of FIG. 1 shown with the opposing pad eyes connected together.

Referring to FIGS. 3A and 3B, further advancement of the structures 10, 12 against each other will eventually cause all the holes 38*a*, 38*b*, 56*a*, 64 and 56*b* to be aligned along a straight line SL, with SL extending along the center line of each hole. Once the pins are properly installed and secured, the springs 82 of all the bumpers are retracted into the channels 84. In one embodiment, when the holes 38*a*, 38*b*, 56*a*, 64 and 56*b* are aligned, the corresponding tapered surfaces 30*a*, 32*a*, 30*b*, 32*b*, 46*a*, 46*b*, 52*a* and 52*b* will also be aligned, so that all the pad eyes 14, 16, 18, 20, 22 will resemble one combined solid block, as shown in FIG. 3A. In addition, the aligned holes 38*a*, 38*b*, 56*a*, 64 and 56*b* will effectively form two separate extended holes, defined as follows: a "first extended hole" defined by hole 56*a*, hole 38*a*, first portion 68*a* and possibly part of center portion 66 (on a first side of the center axis CA), and a "second extended hole" defined by hole 56*b*, hole 38*b*, second portion 68*b* and possibly part of center portion 66 (on a second side of the center axis CA). As can be seen in phantom in FIG. 3A, each extended hole has a configuration that is adapted to receive and fit one pin 100*a* or 100*b*.

Thus, FIGS. 1A–3B show that one pin 100*a* can then be easily and quickly inserted into the first extended hole, and another pin 100*b* can be easily and quickly inserted into the second extended hole. As a pin 100*a* or 100*b* is initially inserted into an extended hole, and before the tapered end 106*a* or 106*b* reaches the hole 64, the tapered section 104*a* or 104*b* of the pin 100*a* or 100*b* does not contact the inner wall of the holes 56*a*, 56*b*, 38*a* and 38*b* because the diameter at the tapered end 106*a* or 106*b* is smaller than the diameter of these holes 56*a*, 56*b*, 38*a*, 38*b* along the path of travel experienced by the inserted tapered end 106*a* or 106*b*. This means that the pin 100*a* or 100*b* encounters less overall friction as it is inserted into its extended hole, as opposed to if the entire extended hole is cylindrical and having the same diameter as the pin. The hinge connection between structures 10 and 12 is completed as the pins 100*a* and 100*b* are advanced into first portion 68*a* and second portion 68*b*.

As set forth above, if only the pad eyes 14, 18 and 20 and the space 74*a* are provided, without providing the other pad eyes 16 and 22, and spaces 72 and 74*a*, then only the first extended hole will be formed, and only one pin 100*a* will be needed. Thus, the first and second extended holes are also symmetrical to each other about the center axis CA.

In addition, the hinge system provides a double shear in that two shear plane areas are created, one adjacent each of the surfaces 30*a*, 32*a*, for pad eye 14, and surfaces 30*b*, 32*b* of pad eye 16. The benefit of providing two shear planes is that the total forces passing through the pin is supported by two shear areas, and the resultant shear stress is half of that experienced by a design that provides a single shear plane. Thus, the two shear planes created by the hinge mechanism of the present invention provide better stress distribution to facilitate a more durable and effective hinge system.

Figure 5:
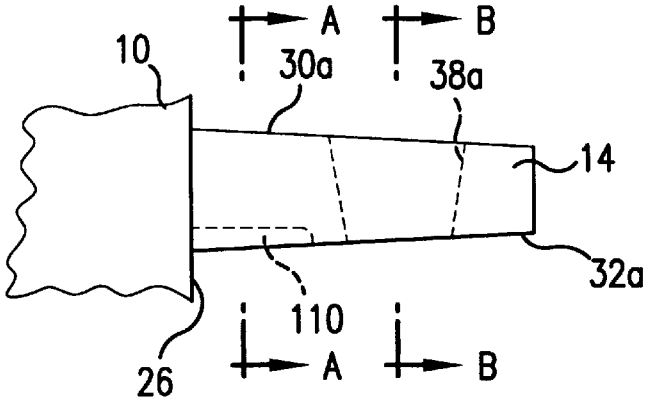
FIG. 5 illustrates an additional feature that can be incorporated by the pad eyes of FIG. 1A.
Figure 5A:
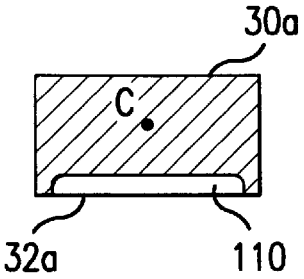
FIG. 5A is a cross-sectional view of the pad eye of FIG. 5 taken along line A—A.
Figure 5B:
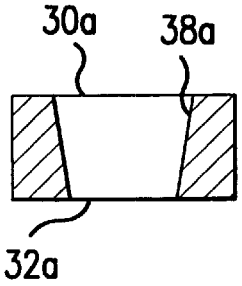
FIG. 5B is a cross-sectional view of the pad eye of FIG. 5 taken along line B—B.

FIGS. 1A and 5 illustrate another possible feature that can be incorporated into the hinge system of the present invention. It is first noted that the pin 100*a* or 100*b* is weaker at its smaller-diameter sections, such as in tapered section 100*a* or 104*b*.Referring to pad eye 14 which is enlarged in FIG. 5, when the pin 100*a* is fully inserted in hole 38*a*, the cross-section of the pin 100*a* at the first surface 30*a* is greater than at the second surface 32*a*, so that the section of the pin 100*a* at the first surface 30*a* can be considered to be "stronger" than the section of the pin 100*a* at the second surface 32*a*. From the standpoint of load distribution at the pin 100*a*, if load is transmitted evenly along the wall in the hole 38*a*, the smaller section of the pin 100*a* at the second surface 32*a*, would experience higher stress, resulting in earlier failure. It is therefore desirable to balance the load at both surfaces 30*a*, 32*a* to be approximately equal. Therefore, to compensate for the uneven strength at the sections of the pin 100*a* at the surfaces 30*a* and 32*a*, a small portion 110 (shown in phantom in FIG. 5) of the pad eye 14 is cut away or hollowed out at the second surface 32*a* adjacent the connecting wall 26. This will cause the geometric center C of the cross-sections (see FIG. 5A) to be moved towards the stronger surface 30*a*. This will result in lesser load at the second surface 32*a* and a greater load at the first surface 30*a*, so that the pin 100*a* will have approximately the same stress at both sections adjacent the first and second surfaces 30*a*, 32*a*.

Figure 6:
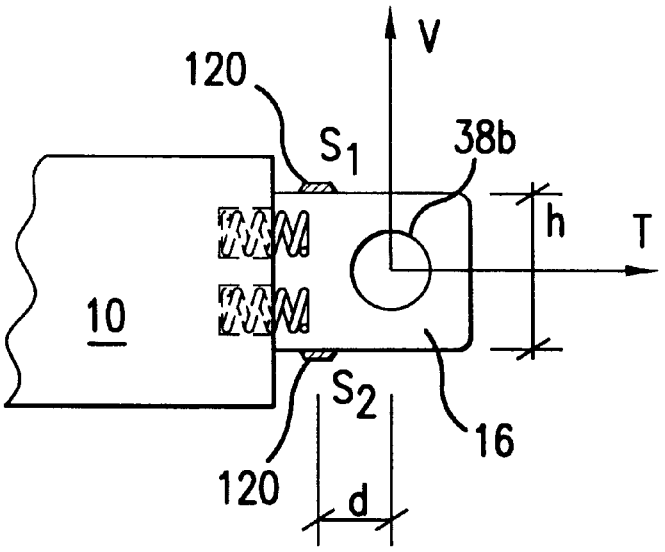
FIG. 6 illustrates strain sensors that can be provided on the pad eyes of FIG. 1A.
Figure 6A:
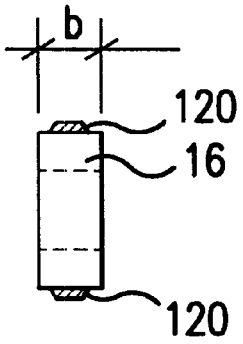
FIG. 6A is a front plan view of the pad eye of FIG. 6.

In addition, a pair of strain sensors 120 can be provided at the top and bottom of each pad eye (e.g., pad eye 16 is shown in FIGS. 6 and 6A) to monitor the instantaneous shear force in each pin 100*a* or 100*b*. The strain sensors 120 can be positioned inboard from the center of the hole 38*b*. Each strain sensor 120 can be implemented in the form of a conventional strain gauge, as is well known in the art. The strain gauge can be coupled to a processor for processing the measured forces using well-known principles. A detailed description of strain gauges, their implementation and their operation is provided in Beckwith & Buck, "Mechanical Measurements", Addison-Wesley Publishing Co., 1961. In this situation, the total force is de-composed into two components: a horizontal component "T" representing the tension pulling the two structures 10, 12 apart, and a vertical component "V" representing the vertical shear force where one structure supports the other structure. Assuming that the pad eye 16 has a rectangular cross-section with a depth of "h" and a width of "b", and the measured stress on the top surface is S1 and the measured stress on the lower surface is S2, then:

A=cross-section area=b*h

SM=section modulus=$b*h^2/6$

T=(S1+S2)/2.0*A

V=(S1−S2)*SM/(2*d)

Total Force F=SQRT ($T^2+V^2$)

To separate the structures 10 and 12, the two pins 100*a* and 100*b* are removed. First, all bumper systems are extended, such as by activating the hydraulic piston 92 for each bumper system to extend the springs 82 outwardly. Then, because of the tapered nature of the pins 100*a* and 100*b*, any force applied on the pin has a tendency to squeeze the pin out of its extended hole. The pin should be extracted when the total force F is at a minimum, or at an acceptably low value so that the structures 10 and 12 experience minimal movement relative to each other when the pin is extracted. Once the pin is retracted a small distance, the outer surface of the pin is separated from the wall of the holes 38*a*, 38*b*, 56*a*, 56*b*, 68*a* and 68*b*, and therefore exerts no frictional forces on the pad eyes. This facilitates a simple release and separation of both structures 10, 12 that is both fast and safe.

Thus, the hinge system can be connected and disconnected very easily and quickly, and in a safe manner. Additional safety can be provided with the optional bumper systems 80, cut-out portions 110, and strain sensors 120.

While the description above refers to particular embodiments of the present invention, it will be understood that many modifications may be made without departing from the spirit thereof. The accompanying claims are intended to cover such modifications as would fall within the true scope and spirit of the present invention. As a non-limiting example, the tapered surfaces 30*a*, 30*b*, 32*a*, 32*b*, 46*a*, 46*b*, 52*a* and 52*b* do not need to be tapered and can be straight, so that each pad eye 14, 16, 18, 20, 22 and space 72, 74*a*, 74*b* can have an essentially rectangular configuration.

What is claimed is:

1. A hinge system for use in connecting a first structure and a second structure, comprising:

a first structure having a connecting wall, and a first pad eye extending from the connecting wall and having a tapered hole extending therethrough;

a second structure having a connecting wall, and a second pad eye extending from the connecting wall of the second structure and having a hole extending therethrough; and a pin having a first end and a second end, with the diameter of the first end smaller than the diameter of the second end;

wherein the first and second pad eyes are positioned such that the holes in the first and second pad eyes are aligned with each other, and the pin is inserted into the holes in the first and second pad eyes with the first end of the pin fitted inside the hole of the first pad eye.

2. The hinge system of claim 1, wherein the second structure further includes a third pad eye extending from the connecting wall of the second structure and having a tapered hole extending therethrough, with the second and third pad eyes defining a first space therebetween for receiving the first pad eye, and wherein the first, second and third pad eyes are positioned such that the holes in the first, second and third pad eyes are aligned with each other, and the pin is inserted into the holes in the first, second and third pad eyes.

3. The hinge system of claim 1, wherein the first pad eye has a first surface and an opposing second surface, and the hole of the first pad eye is tapered such that its diameter at the first surface is greater than its diameter at the second surface.

4. A hinge system for use in connecting a first structure and a second structure, comprising:

a first structure having a connecting wall, and a first pad eye extending from the connecting wall and having a tapered hole extending therethrough;

a second structure having a connecting wall, and a second pad eye extending from the connecting wall of the second structure and having a hole extending therethrough; and a pin having a first end and a second end, with the diameter of the first end smaller than the diameter of the second end;

wherein the first and second pad eyes are positioned such that the holes in the first and second pad eyes are aligned with each other, and the pin is inserted into the holes in the first and second pad eyes;

wherein the second structure further includes a third pad eye extending from the connecting wall of the second structure and having a tapered hole extending therethrough, with the second and third pad eyes defining a first space therebetween for receiving the first pad eye, and wherein the first, second and third pad eyes are positioned such that the holes in the first, second and third pad eyes are aligned with each other, and the pin is inserted into the holes in the first, second and third pad eyes;

wherein the first structure further includes a fourth pad eye extending from the connecting wall of the first structure and having a tapered hole extending therethrough, with the first and fourth pad eyes defining a second space therebetween for receiving the third pad eye, and wherein the second structure further includes a fifth pad eye extending from the connecting wall of the second structure and having a hole extending therethrough, with the third and fifth pad eyes defining a third space therebetween for receiving the fourth pad eye; and further including a second pin having a first end and a second end, with the diameter of the first end smaller than the diameter of the second end, and wherein the third, fourth and fifth pad eyes are positioned such that the holes in the third, fourth and fifth pad eyes are aligned with each other, and the second pin is inserted into the holes in the fifth, fourth and third pad eyes.

5. The hinge system of claim 4, wherein the first pad eye has a first tapered surface and a second tapered surface that are angled towards each other, and wherein the second pad eye has a third tapered surface and the third pad eye has a fourth tapered surface, with the third and fourth tapered surfaces defining a widened opening for the first space.

6. The hinge system of claim 5, wherein the fourth pad eye has a fifth tapered surface and a sixth tapered surface that are angled towards each other, and wherein the fifth pad eye has a seventh tapered surface and the third pad eye has an eighth tapered surface, with the seventh and eighth tapered surfaces defining a widened opening for the third space.

7. The hinge system of claim 6, wherein the second and fifth tapered surfaces define a widened opening for the second space.

8. A hinge system for use in connecting a first structure and a second structure, comprising:

a first structure having a connecting wall, and a first pad eye extending from the connecting wall and having a tapered hole extending therethrough;

a second structure having a connecting wall, and a second pad eye extending from the connecting wall of the second structure and having a hole extending therethrough; and a pin having a first end and a second end, with the diameter of the first end smaller than the diameter of the second end;

wherein the first and second pad eyes are positioned such that the holes in the first and second pad eyes are aligned with each other, and the pin is inserted into the holes in the first and second pad eyes;

wherein the first structure further includes a bumper system provided along the connecting wall at a position opposite the second pad eye, and the second structure further includes a bumper system provided along the connecting wall at a position opposite the first pad eye.

9. A hinge system for use in connecting a first structure and a second structure, comprising:

a first structure having a connecting wall, and a first pad eye extending from the connecting wall and having a tapered hole extending therethrough, the first pad eye having a first surface and an opposing second surface, and the hole of the first pad eye is tapered such that its diameter at the first surface is greater than its diameter at the second surface;

a second structure having a connecting wall, and a second pad eye extending from the connecting wall of the second structure and having a hole extending therethrough; and a pin having a first end and a second end, with the diameter of the first end smaller than the diameter of the second end;

wherein the first and second pad eyes are positioned such that the holes in the first and second pad eyes are aligned with each other, and the pin is inserted into the holes in the first and second pad eyes; and wherein the second pad eye has a first surface and an opposing second surface, and wherein the hole of the second pad eye is cylindrical, with the diameter of the hole of the second pad eye at the second surface being the same as the diameter of the hole of the first pad eye at the first surface.

10. A hinge system for use in connecting a first structure and a second structure, comprising:

a first structure having a connecting wall, and a first pad eye extending from the connecting wall and having a tapered hole extending therethrough, the first pad eye having a first surface and an opposing second surface, and the hole of the first pad eye is tapered such that its diameter at the first surface is greater than its diameter at the second surface;

a second structure having a connecting wall, and a second pad eye extending from the connecting wall of the second structure and having a hole extending therethrough; and a pin having a first end and a second end, with the diameter of the first end smaller than the diameter of the second end;

wherein the first and second pad eyes are positioned such that the holes in the first and second pad eyes are aligned with each other, and the pin is inserted into the holes in the first and second pad eyes; and wherein the first pad eye further includes a cut-out section on the second surface.

11. A hinge system for use in connecting a first structure and a second structure, comprising:

a first structure having a connecting wall, and a first pad eye extending from the connecting wall and having a tapered hole extending therethrough;

a second structure having a connecting wall, and a second pad eye extending from the connecting wall of the second structure and having a hole extending therethrough; and a pin having a first end and a second end, with the diameter of the first end smaller than the diameter of the second end;

wherein the first and second pad eyes are positioned such that the holes in the first and second pad eyes are aligned with each other, and the pin is inserted into the holes in the first and second pad eyes; and further including a strain sensor provided on the first pad eye.

12. The hinge system of claim 11, wherein the first end of the pin is fitted inside the hole of the first pad eye.

13. A hinge system for use in connecting a first structure and a second structure, comprising:

a first structure having a connecting wall, and a first pad eye extending from the connecting wall and having a tapered hole extending therethrough;

a second structure having a connecting wall, and a second pad eye extending from the connecting wall of the second structure and having a hole extending therethrough; and a pin having a first end and a second end, with the diameter of the first end smaller than the diameter of the second end;

wherein the first and second pad eyes are positioned such that the holes in the first and second pad eyes are aligned with each other, and the pin is inserted into the holes in the first and second pad eyes; and wherein the second end of the pin is fitted inside the hole of the second pad eye.

14. A hinge system for use in connecting a first structure and a second structure, comprising:

a first structure having a connecting wall, and a first pad eye extending from the connecting wall and having a tapered hole extending therethrough;

a second structure having a connecting wall, and a second pad eye extending from the connecting wall of the second structure and having a hole extending therethrough; and a pin having a first end and a second end, with the diameter of the first end smaller than the diameter of the second end;

wherein the first and second pad eyes are positioned such that the holes in the first and second pad eyes are aligned with each other, and the pin is inserted into the holes in the first and second pad eyes;

wherein the second structure further includes a third pad eye extending from the connecting wall of the second structure and having a tapered hole extending therethrough, with the second and third pad eyes defining a first space therebetween for receiving the first pad eye, and wherein the first, second and third pad eyes are positioned such that the holes in the first, second and third pad eyes are aligned with each other, and the pin is inserted into the holes in the first, second and third pad eyes; and wherein the first end of the pin is fitted inside the hole of the third pad eye.

* * * * *